United States Patent [19]

Moran

[11] 3,939,777

[45] Feb. 24, 1976

[54] MOBILE TRACKWAY

[76] Inventor: Raymond D. Moran, 11607 E. Firestone Blvd., Norwalk, Calif. 90650

[22] Filed: Jan. 24, 1975

[21] Appl. No.: 543,799

Related U.S. Application Data

[63] Continuation of Ser. No. 447,997, June 10, 1974, abandoned.

[52] U.S. Cl. ..... 104/137; 37/8; 61/42; 61/84; 105/413; 198/188; 214/41 R

[51] Int. Cl.[2] E21D 9/12; B61B 13/00; B65G 67/08; E02F 7/00

[58] Field of Search ..... 104/18, 130, 132, 137, 104/242; 105/158 R, 159, 161, 164, 364, 368 R, 371, 413, 414, 419, 420; 214/41; 198/139, 188; 238/10 R; 299/64, 65; 61/42, 84; 37/8

[56] References Cited

UNITED STATES PATENTS

| | | | |
|---|---|---|---|
| 650,927 | 6/1900 | Crosby | 238/10 R |
| 955,398 | 4/1910 | Harris | 105/159 |
| 1,762,074 | 6/1930 | Paisley | 198/188 |
| 2,796,969 | 6/1957 | Russell | 198/139 X |
| 2,796,999 | 6/1957 | Russell | 214/41 |
| 2,906,212 | 9/1959 | Hayes | 104/137 |
| 2,907,481 | 10/1959 | Russell | 104/137 X |
| 3,138,327 | 6/1964 | Jacobs | 238/10 R |
| 3,365,895 | 1/1968 | Jacobs | 238/10 R X |
| 3,626,855 | 12/1971 | Fogelstrom | 238/10 R X |
| 3,678,694 | 7/1972 | Haspert | 61/84 |

*Primary Examiner*—Evon C. Blunk
*Assistant Examiner*—Andres Kashnikow
*Attorney, Agent, or Firm*—Gausewitz, Carr & Rothenberg

[57] ABSTRACT

A mobile trackway comprises a plurality of interconnected carriages adapted for rolling on an existing trackway, and having mounted on upper surfaces thereof two side-by-side trackways. Ramp cars (which form part of the mobile trackway) and switching sections on the carriages permit load-transporting cars to be moved to either of the two trackways from the existing trackway. When used in conjunction with tunneling machinery, a string of muck cars is positioned on one of the trackways and may be conveyor loaded while previously loaded cars are removed from, and empty cars are delivered to, the other trackway. The carriages are of hollow shell construction and are adapted for carrying ballast, for example excavated rock, scrap iron or concrete, to prevent being tipped over by any arrangement of loaded muck cars thereupon. No other stabilization means, such as outriggers or supporting members contacting the tunnel, is required. Recessed carriage wheels allow a low center of gravity and maximum ballasting capacity with minimum use of tunnel space. The mobile trackway is adapted for being towed by a tunneling machine so as to move therewith, rail sections being added to the tunnel trackway in front of the advancing mobile trackway which rides thereupon.

28 Claims, 8 Drawing Figures

5
5
26
26
28
30
32
34
36
38
62
64
66
68
70
72
74
76
78

MOBILE TRACKWAY

This is a continuation of application Ser. No. 447,997, filed June 10, 1974, now abandoned.

BACKGROUND OF THE INVENTION

1. Field of the Invention

The invention relates generally to the field of mobile trackways. More particularly, it relates to mobile trackways adapted to move over existing trackways, for example those found in tunnels.

2. Description of the Prior Art

Railroad type trackways are, as a rule, laid in the tunnel behind advancing tunneling equipment so that muck cars be brought to the tunnel head for removing the tunnel borings (commonly called muck). Ordinarily, because of the expense, and for other reasons, only a single trackway is laid. Consequently, when one string of muck cars has been loaded at the tunnel head, the tunneling operation must be curtailed until that string of cars can be removed and an empty string can be moved into loading position. Since many tunnels are several miles long an appreciable amount of time is thereby wasted and tunneling costs are correspondingly increased.

To prevent such tunneling interruptions, and as an alternative to laying a second trackway in the tunnel (which may be additionally difficult in a round tunnel because of tunnel curvature and which requires two separate locomotives and/or crews, with consequent great added expense), comparatively short, mobile or movable dual trackways are used. These movable dual trackways are advanced behind the tunneling equipment and provide for two side-by-side strings of muck cars at the tunnel head where they are needed. Empty muck cars on one of the trackways may be loaded while loaded muck cars are removed from the other trackway. Muck cars are brought to, and removed from, the movable trackway via a single trackway laid on the tunnel floor.

Heretofore available movable dual trackways have, however, frequently proved impractical or impossible to use, particularly in round (in cross-section) tunnels having sections which are unlined.

Relatively wide, flat tunnel floors are required to accomodate some types of movable, unwheeled dual trackways which are slid along the tunnel floor on skids in advance of a conventional trackway. These types generally comprise several interconnected sections which are advanced one section at a time in "inchworm" fashion. Tunneling equipment must often be placed on sections not being moved to anchor (by friction) these sections to the tunnel floor while another section is pushed or pulled (as by hydraulic pistons) forwardly. Although the expense of laying a second trackway in the tunnel is thereby avoided, a considerable amount of time is wasted in inching the movable trackway forwardly and in moving the tunneling equipment about. It is emphasized that when the tunneling equipment is being used to weight sections of the movable trackway, it cannot be used to tunnel.

Lined tunnel walls, having affixed thereto special guide members or rails, are required for the movement of other types of movable dual trackways. These movable trackways are elevated above a tunnel trackway and are slid along the guide members. Although they are more adaptable for round tunnels than the previously described types, they require tunnel liners to support their weight and the weight of the loaded muck cars. Many sections of tunnels, however, otherwise require no lining, hence use of these types of movable trackways requires expenditure of considerable extra time and money. It is economically impractical to line tunnel portions, which portions would otherwise not need lining, simply to accommodate movable trackways.

Ideally, movable dual trackways should have wheels and be transportable along the existing tunnel trackway in the manner of some existing, movable single trackway units. But eccentric forces caused by the loaded muck cars on one of the dual trackways, while the other trackway is empty of cars, tend to cause the movable trackway to tip over sideways. It has heretofore been necessary to employ outriggers or braces which bear against the tunnel to prevent this tipping. However, with such braces in position it is virtually impossible to move the trackway. The trackway must thus remain stationary as the muck cars thereupon are loaded, even though the tunneling equipment itself is advancing. This requires additional time and expense to move the muck from the tunnel head to the cars. The problems involved in positioning and removing braces are major and time-wasting.

Existing movable single trackways which are adapted to roll along another trackway do not encounter the problem of eccentric loading because the single trackway is mounted along the center line of the unit. Thus there is little tendency — other than as a result of a high center of gravity — for such trackways to tip over. But movable single trackways are generally limited to the transport of, for example, wider gauge cars over a narrow gauge trackway, and are obviously not adaptable for the purpose of transporting two side-by-side strings of load-bearing cars.

Heretofore, to the applicant's knowledge, there have been no movable dual trackways adapted to roll over existing tunnel trackways which do not require such bracing as described above and which may be moved in substantial unison with the tunneling equipment.

SUMMARY OF THE INVENTION

In carrying out principles of the present invention according to a preferred embodiment, a mobile trackway, adapted for traveling over an existing trackway, comprises one or more carriages upon which are mounted trackway means adapted for movement of load-transporting cars thereupon. A ramp allows movement of the load-transporting cars between the existing trackway and the trackway means. Stabilization means, integral to the carriages, prevent tipping thereof by any arrangement of loaded cars thereupon.

More specifically, a mobile trackway, adapted for use at a tunnel head, comprises a number of interconnected wheeled carriages having mounted thereupon two side-by-side trackways. Switching elements, also mounted thereupon, allow muck cars, which are moved onto the mobile trackway via ramp cars attached thereto, to be positioned on either of the two trackways. The mobile trackway is attached to the tunneling machine by a tow cable and is towed therebehind. Rail sections are added to the tunnel trackway, upon which the mobile trackway rides, in front of the mobile trackway as it advances. A belt conveyor, mounted upon the carriages so as to be above the trackways, loads muck cars on either of the trackways. A string of muck cars on one of the trackways may thus be loaded while a locomotive removes a string of loaded muck cars from, and delivers a string of empty muck cars to, the other trackway. No tunneling time is lost while strings of muck cars are moved in and out of the tunnel and the expense of a double tunnel trackway is avoided.

Carriages of the mobile trackway, having a general trapezoidal cross section with the top being much wider than the bottom so as to conform to the shape of a circular cross section tunnel, are formed into hollow shells capable of carrying sufficient ballast — for example, excavated rock, scrap iron or concrete — to prevent being tipped over by the eccentric force of loaded muck cars on only one of the trackways. This ballasting is the sole means of carriage stabilization, the carriages requiring no outriggers or braces contacting the tunnel or other structure.

The mobile trackway moves upon an existing tunnel trackway and is particularly adaptable for tunnels having unlined sections, thereby making unfeasible use of other types of movable trackways requiring guide members or rails affixed to tunnel linings. The mobile trackway may be moved from tunnel to tunnel or used in other applications where a section of dual trackway is temporarily required.

DESCRIPTION OF THE PREFERRED EMBODIMENT

Figure 1A:
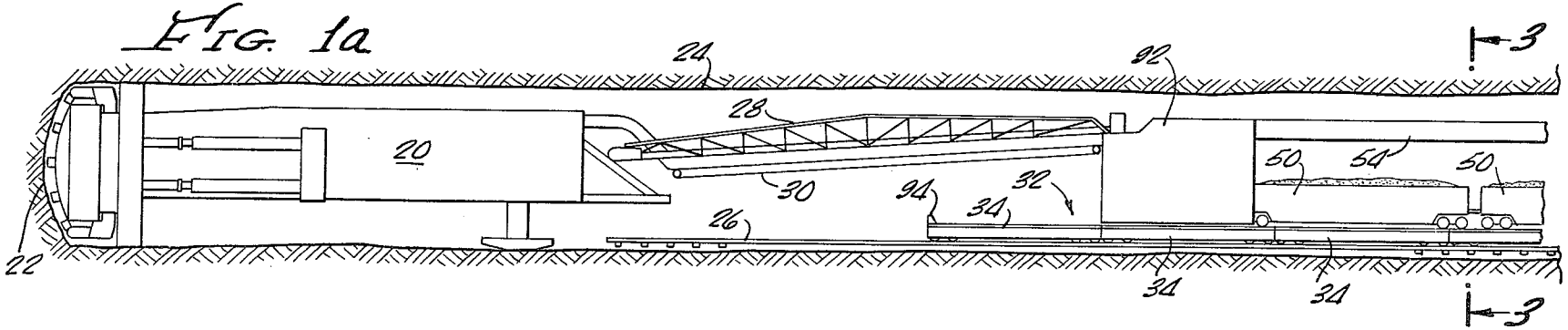
FIGS. 1*a* and 1*b* are side elevation views showing the mobile trackway in position at a tunnel head behind a boring machine.
Figure 1B:
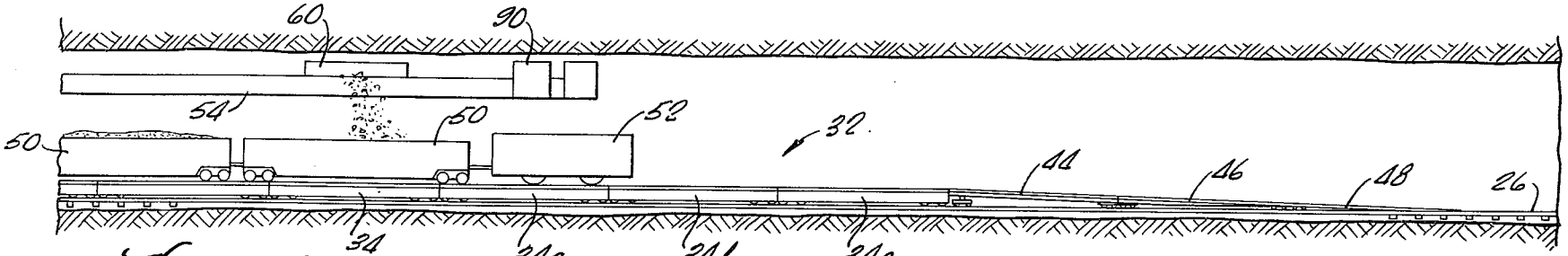

FIGS. 1*a* and 1*b* show a conventional tunneling machine 20 (for example a Robbins boring machine) at a tunnel head 22 of a tunnel 24. As the tunneling machine advances, a tunnel trackway 26 is laid therebehind on the tunnel floor so that the muck can be removed easily by muck cars.

An open space conveyor 28 and a tow cable 30 connect the machine 20 to a mobile trackway 32 which permits loading of one string of muck cars while a loaded string is removed and replaced by a string of empty cars.

The mobile trackway 32 comprises a number of similar interconnected carriages adapted to roll on the tunnel trackway 26.

Figure 2:
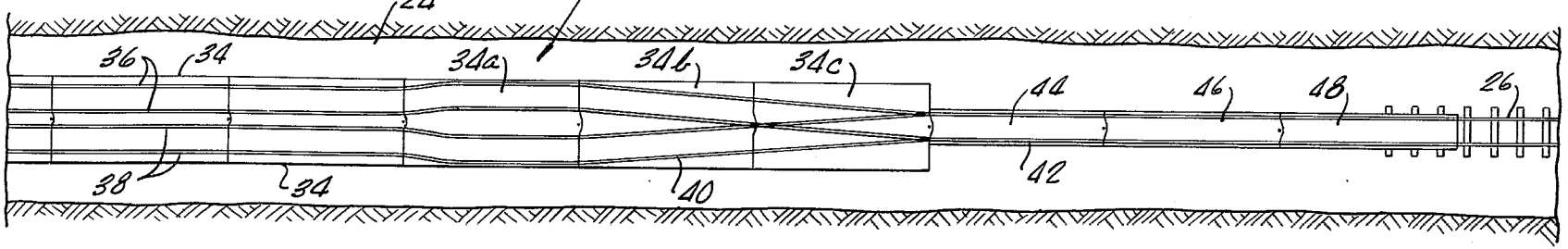
FIG. 2 is a top plan view showing rearward sections of the mobile trackway.
Figure 3:
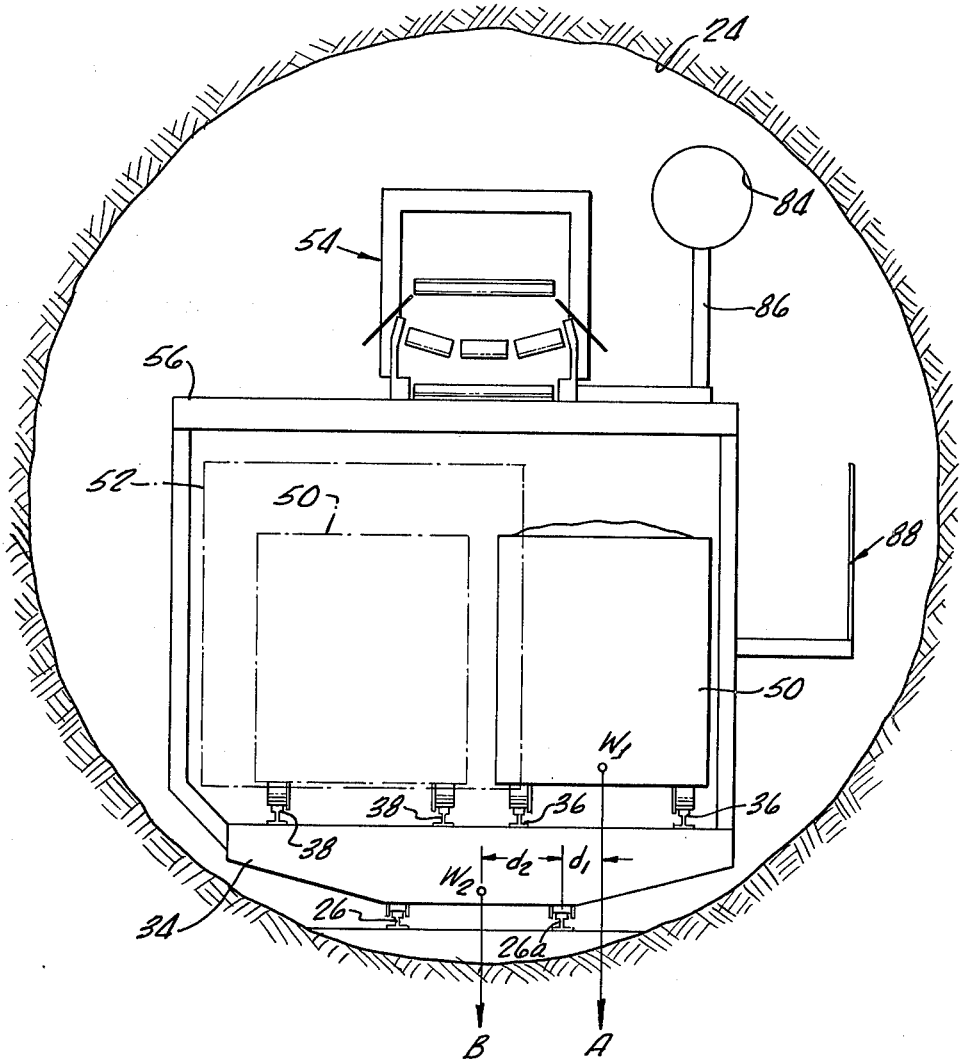
FIG. 3 is a horizontal section along line 3–3 of FIG. 1*a*, showing the mobile trackway in a tunnel.

Except for the trackway arrangement thereupon all of the carriages are identical. There are a number (preferably about ten) of lead carriages 34 which are connected together behind the tunneling machine. Upon these carriages 34 two substantially parallel trackways 36 and 38 are laid in a symmetrical manner about the longitudinal axis of the carriages (FIGS. 2 and 3). These trackways are laid closely together, the spacing being sufficient only to allow movement of muck cars on each trackway. A locomotive passing carriage 34a is connected to the rearmost carriage 34. Upon this carriage the trackways are curved outwardly toward the edges thereof, the increased spacing between the trackways allowing clearance between muck car locomotives which are wider than the muck cars and which may be required to be side by side in this region of the mobile trackway. Connected to the carriage 34*a* are two switching carriages 34*b* and 34*c*. These two carriages have mounted thereupon switching track elements 40 allowing sections of either trackway 36 or 38 to be moved into alignment with a section of trackway 42 which is mounted on ramp cars 44, 46 and 48 at the end of the mobile trackway and which is registered with the tunnel trackway 26 behind the mobile trackway. Since the trackways on the carriages 34, 34*a*, 34*b* and 34*c* are elevated above the trackway 26, the ramp cars 44, 46 and 48 form an inclined runway to allow muck cars to move between the tunnel trackway 26 and the carriage trackways 36 and 38.

It should be noted that the term "trackway" as used herein and in the appended claims denotes provision for passage of a vehicle. The term thus includes, for example, a pair of rails for passage of railway cars. The term "dual trackway" consequently denotes, for example, two pairs of rails for railway cars.

One string of muck cars 50 may be backed along the trackway 26, up the ramp cars and, for example, onto the trackway 36 (via the switching element 40) by a locomotive 52. While these muck cars are being loaded by means of a belt conveyor 54, which is mounted on a framework 56 attached to the carriages 34 (FIG. 3), the locomotive proceeds to the entrance of the tunnel. It then returns with a second string of empty muck cars, these being moved onto the trackway 38. Without the mobile trackway this could be accomplished only if a second trackway, similar to the tunnel trackway 26, were laid the entire length of the tunnel. Installation of such a dual trackway, even if allowed by the width of the tunnel floor (which it ordinarily would not be) would be prohibitively expensive and time consuming. Furthermore, it would either require two separate locomotives, or create the major problem of how to switch the locomotive from one trackway to the other.

As the tunneling machine advances it tows the mobile trackway 32 behind it by means of the tow cable 30. New sections of the tunnel trackway 26 are laid in advance of the forwardmost carriage 34. Muck moving along the belt conveyor 54 is caused to be discharged into muck cars on either of the trackways by a diverter 60 (FIG. 1*b*) which moves along the conveyor above the string of muck cars. A gate (not shown) which is in contact with the conveyor can be positioned to cause the muck to fall off either side thereof into cars on either trackway. The diverter can travel the length of the carriages 34 and thus can cause muck cars in any location on these carriages to be loaded without the necessity for the cars themselves to be moved.

The necessary lateral offsetting of the trackways 36 and 38 from the longitudinal axis of the carriages causes loaded muck cars on either of the trackways (when there are not loaded muck cars on the other trackway) to exert a very great moment tending to tip over thte carriages, particularly because of the comparatively small lateral wheel spacing of the carriages. Since large tunnel regions may require no lining to shore up the walls, it is not feasible to use carriage outriggers or braces which must necessarily bear against or slide along structural elements attached to the tunnel walls. Tipping of the carriages is, in accordance with the present invention, prevented solely by their being heavily ballasted, as described below.

The most severe loading condition is with fully loaded muck cars on one trackway (for example, the trackway 36 as depicted in FIG. 3) with no cars on the other trackway (in FIG. 3 possible location of muck cars on the trackway 38 is shown by phantom lines). Because the trackways 36 and 38 are located side by side and because of the comparatively narrow wheel base of the carriages 34 (approximately 36 inches for the preferred embodiment) the center of gravity of the loaded muck cars — having a total weight of $W_1$ pounds — is outboard of the closest rail (identified by the number 25*a*) of the trackway 26 by a distance $d_1$ (approximately 9 inches in the preferred embodiment). The weight $W_1$, acting downwardly as shown by the arrow "A", causes a moment equal to $W_1 \times d_1$ about the rail 26*a*. This tends to tip the carriage over (in a clockwise direction as shown in FIG. 3). The weight $W_2$ of the carriages (which though distributed may be considered as acting along the arrow "B" through the center of gravity of the carriages, that is, through their center lines) acting at a distance $d_2$ from the rail 26*a*, which is equal to the half width of the wheel separation (or 18 inches) creates a countermoment equal to $W_2 \times d_2$ to prevent tipping. For the example given $W_2$ must be greater than ½ $W_1$ to assure stability ($W_2 \times d_2 > W_1D_1$; $W_2 \times 18 < W_1 \times 9$; $W_2 > ½ W_1$). Thus, the trackways 36 and 38 must be placed as closely together as possible, consistent with the necessity for providing clearance between muck cars on both trackways, to minimize the distance $d_1$ and hence minimize the ballasted weight $W_2$ of the carriages.

Figures 4, 6, 7:
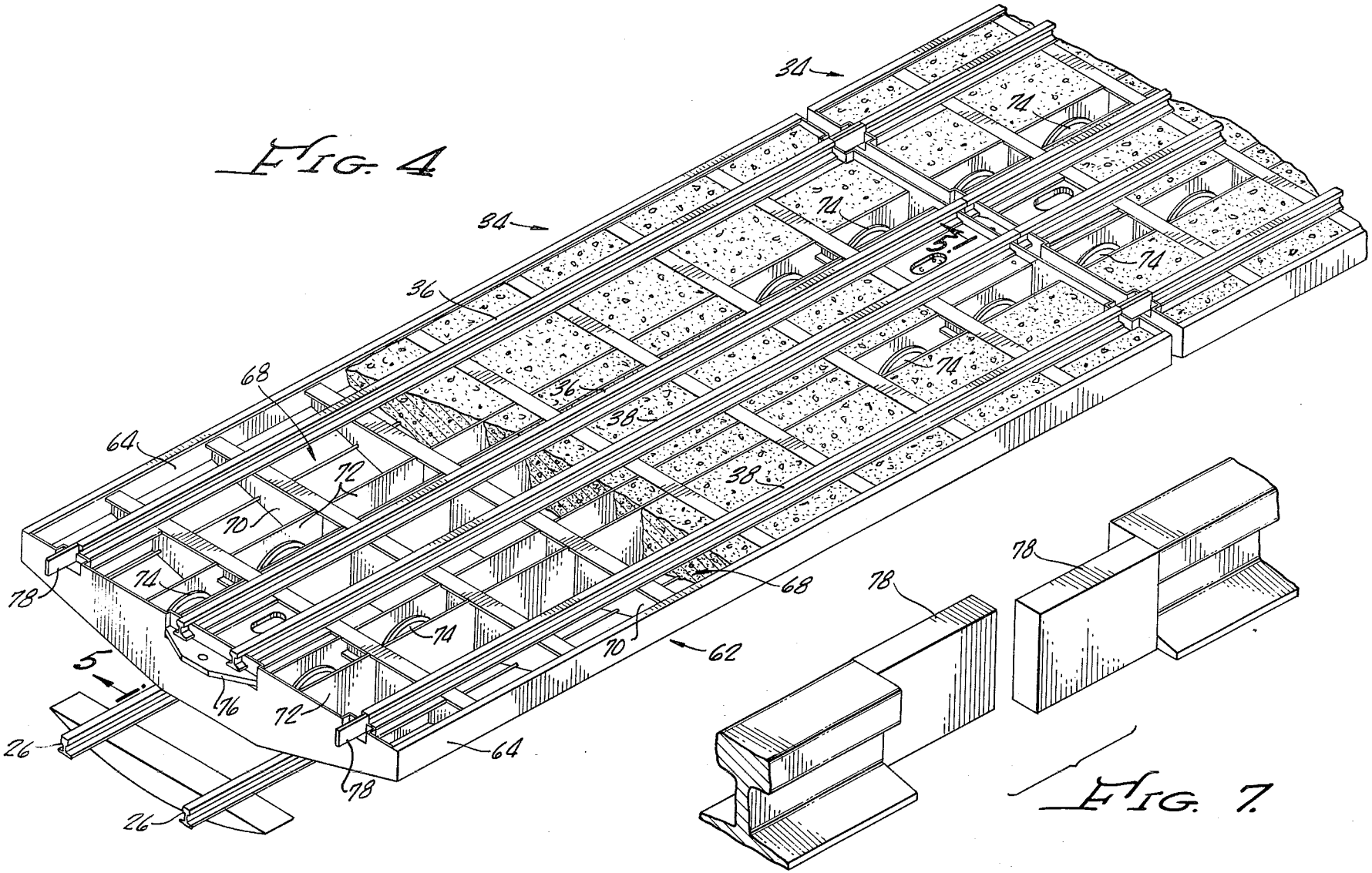
FIG. 4 is a perspective view of one of the carriages of the mobile trackway, but with some of the ballast unshown.
FIG. 6 is a horizontal section along line 6—6 of FIG. 5, depicting the compartmentation of the carriage.
FIG. 7 is an exploded view showing the mating of outboard tracks on adjacent carriages.

As shown in FIGS. 4 and 6, a carraige bed 62, used for carriages 34, 34*a*, 34*b* and 34*c*, has a generally trapezoidal cross section wider at the top than the bottom to conform to the shape of a round-sectioned tunnel. Sides 64 and a bottom 66 form a shell which is divided into numerous compartments (typified by the reference number 68 in FIG. 4) by multiple transverse bulkheads 70 and multiple longitudinal bulkheads 72. These compartments are adapted for filling with available heavy ballast such as excavated rock or scrap iron (which may be removed when relocating the carriages) or with concrete. The total volume of all of the compartments (which may be about 230 cubic feet for a typical carriage bed having a length of 20 feet, a width of 10 feet and a depth of 1 ½ feet at its deepest point) is such that when filled with ballast the carriage is caused to resist tipping over even when fully loaded muck cars are on a single trackway 36 or 38 as above described. No outriggers or braces contacting any portion of the tunnel are required to prevent tipping. (To illustrate the structure some of the compartments are shown without ballast.)

Figure 5:
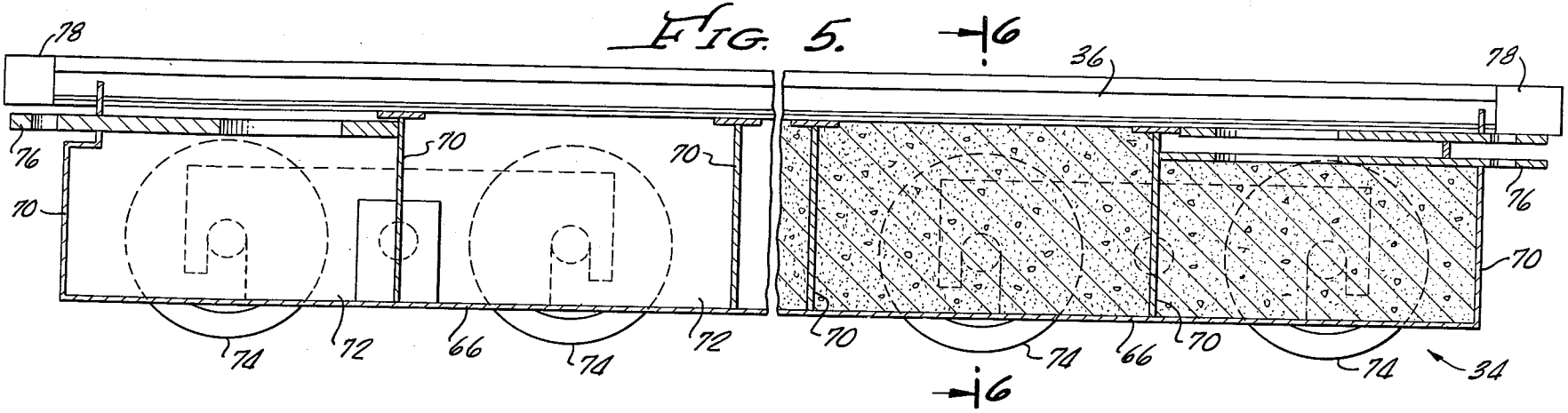
FIG. 5 is a horizontal sectional view along 5—5 of FIG. 4, illustrating the mounting of the carriage wheels.
Figure 6:
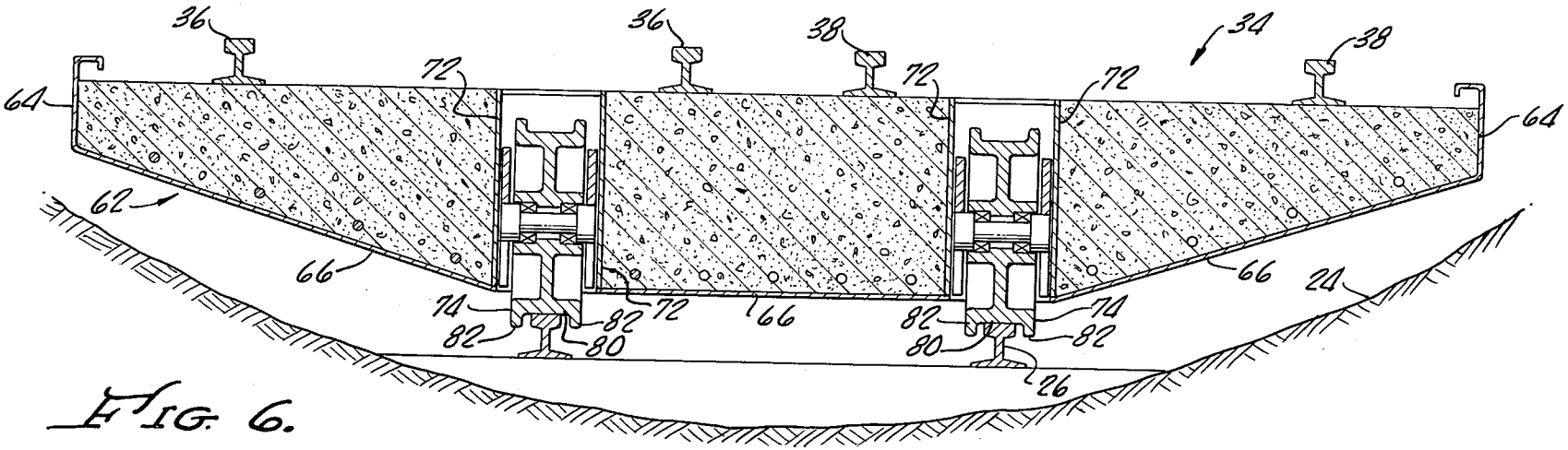

A desirable low center of carriage gravity is achieved by recessing wheels 74 well into the bottom of the carriage bed (FIGS. 5 and 6). This wheel recessing provides a substantial depth to the carriage bed 62, while at the same time minimizes the height of the trackways 36 and 38 above the tunnel trackway 26, thereby maximizing clearance between the muck cars and the tunnel.

Because substantially continuous trackways must be formed by the interconnected carriages, relatively little nonalignment of adjacent carriages is allowed. The most inward rails of the trackways 36 and 38 project slightly beyond the ends of the carriage beds 62 so that when adjacent cars are coupled together by a pin (not shown) passing through a projecting coupling 76 at each end of the carriage bed, adjacent ends of these rails are closely adjacent to each other. The outermost rails of the trackways 36 and 38 terminate at each end of the carriage bed 62 in a projecting, rectangular bar 78. The bars 78, as shown in FIG. 7, are approximately half the width of the upper flange of the rails. They are positioned to one side of the rails so that when two adjacent carriage beds are in longitudinal alignment the bars 78 on adjacent rails overlap and are in close proximity so as to bridge the gap between the ends of the rails. When the carriages are on a curved section of the trackway 26, the ends of the outermost rails are spaced apart. However, the bars 78 are of a length that there is still sufficient overlap to bridge the gap between the adjacent rail ends.

To further provide for continuity of the trackways 36 and 38 when the mobile trackway is on a curved section of the trackway 26, the wheels 74 of the carriage beds are constructed with central regions 80 (bounded on either side by wheel flanges 82) which are substantially wider than the upper flange of the trackway 26 rails. The carriages may therefore be skewed somewhat out of alignment with the longitudinal axis of the trackway 26, without the carriages leaving the tracks.

As shown in FIG. 3, in order to provide side clearance so that the locomotive 52 (shown in phantom lines) may be moved down the trackway 38 to the end of the mobile trackway adjacent to the tunneling machine 20 (as may be necessary to service the machine), each framework 56 for supporting the belt conveyor 54 projects outwardly beyond the edge of its carriage bed on the trackway 38 side of the carriage. Because of the necessity for maintaining the trackways 36 and 38 as closely together as possible upon the carriages to minimize the tipping moment, provision is not made for allowing a locomotive on one of the trackways (other than on the carriages 34*c*) at the same time that there are muck cars on the other trackway. There is seldom an occasion when this would be desirable. However, it is within the scope of the invention but heavier ballasting of the carriages is required.

Also as shown in FIG. 3, a ventilation duct 84 may be routed above the carriages 34, 34*a*, 34*b* and 34*c*, being supported above the supports 56 by a support member 86. A walkway 88 may be attached to one side of the framework 56 to enable an operator to bypass, or to have access to, the muck cars.

In the preferred embodiment ten of carriages 34 and one each of carriages 34*a*, 34*b*, 34*c* and ramp cars 44, 46 and 48 are used. The mobile trackway so comprised has an approximate total length of 300 feet. A greater or fewer number of carriages may, however, be used as the particular tunneling operation dictates. The belt conveyor 54 extends approximately the length of the ten carriages 34 (approximately 200 feet) and is driven by a drive motor and gear box 90 which is located above the carriage 34*c* (FIG. 1*b*).

SUMMARY OF OPERATION OF THE MOBILE TRACKWAY

The mobile trackway 32 is positioned behind the tunneling machine 20 at the tunnel head, as previously stated. A forward structure 92 on one of the forewardmost carriages 34 is connected to the tunneling machine by the tow cable 30 (FIG. 1*a*). The open span conveyor 28 is positioned to discharge muck from the tunneling machine onto the belt conveyor 54. A locomotive pushes a string of muck cars along the tunnel trackway 26 and up the ramp cars. The switching element 40 causes the muck cars to be diverted to either of the trackways 36 or 38, as may be desired. The muck cars are moved to the end of the mobile trackway adjacent the tunneling machine. A stop 94 (FIG. 1*a*) at the end of the forwardmost carriage 34 prevents the muck cars from rolling off the mobile trackway.

When the muck cars are in position for loading they are uncoupled from the locomotive, which then returns to the entrance of the tunnel for another string of empty muck cars. The muck cars already in position are loaded sequentially from the belt conveyor 54 by means of the traveling diverter 60 which diverts muck from the belt conveyor into the cars. A sufficient number of muck cars are positioned for loading so that the locomotive may return with a string of unloaded muck cars before the string being loaded is completely loaded. The second string of muck cars is moved onto the vacant trackway on the mobile trackway. When the first string of muck cars is completely loaded, the locomotive, which has in the meantime been reconnected to that string of muck cars, removes the loaded muck cars, the muck being diverted by the diverter 60 to the second string of muck cars.

As the tunneling machine 20 advances, new sections of the tunnel trackway 26 are added in advance of the mobile trackway, thereby allowing continual advancement of the mobile trackway with the tunneling machine.

When the tunneling operation is completed, or at any time it is so desired, the mobile trackway may be disconnected from the tunneling machine and hauled back along the trackway 26 to the entrance of the tunnel.

Although the preferred embodiment has illustrated uniform ballasting of the carriage beds 62, the scope of the invention includes the shifting of ballast materials (for example by pumping a liquid or conveying a solid) from one side or part of the carriage bed to another so as to achieve carriage stability with a lesser carriage weight, as may be desirable in some structurally weak tunnels, although such ballast shifting will generally be more difficult to accomplish and hence be less desirable.

And although the preferred embodiment employs wheels which enable the carriages to roll along an existing trackway, it is to be understood that the scope of the invention includes use of slidable track engaging members such as skids which may be attached to ballasted carriages.

The foregoing description is thus by means of illustration only and no limitations are thereby intended, and the scope of the invention is limited solely by the claims.

I claim:

1. A mobile trackway, comprising:

a. carriage means adapted for moving along and existing trackway, b. first trackway means provided on said carriage means and adapted for movement thereupon of load-transporting cars, c. second trackway means provided on said carriage means and also adapted for movement thereupon of load-transporting cars, said first and second trackway means being in such positions relative to each other that mounting of cars on only one of said trackway means creates a moment tending to tip over said carriage means, and d. stabilizing means for maintaining said carriage means in a substantially untipped, sttable condition regardless of the positioning and loading of said load-transporting cars on said trackway means, said stabilizing means cooperating with said carriage means in such manner that no substantial lateral projections from said carriage means are required and no carriage contact with other than said existing trackway is required.

2. The mobile trackway of claim 1 wherein said stabilizing means includes ballast means.

3. The mobile trackway of claim 2 wherein said ballast means includes stationary ballast provided in said carriage means.

4. The mobile trackway of claim 2 wherein said ballast means includes installation in said carriage means of ballast which is transferable from one part of said carriage means to another part thereof.

5. The mobile trackway of claim 1 wherein said stabilizing means includes ballast compartments formed in said carriage means, said compartments being adapted for carrying large quantities of heavy materials such as rock, concrete and scrap iron.

6. The mobile trackway of claim 1 wherein said carriage means include ramp means whereby said load-transporting cars may move between said existing trackway and said first and second trackway means.

7. The mobile trackway of claim 6 wherein said first and second trackway means includes at least one section of trackway provided on said ramp means and registered with said existing trackway.

8. The mobile trackway of claim 7 wherein said first and second trackway means further includes switching means for switching said load-transporting cars between said registered section of trackway and other trackway sections of said first and second trackway means.

9. The mobile trackway of claim 1 wherein said carriage means includes wheels adapted for rolling on said existing trackway.

10. The mobile trackway of claim 1 wherein said carriage means includes means for loading said load-transporting cars when said load-transporting cars are on either of said first and second trackway means.

11. The mobile trackway of claim 1, in which said existing trackway is an existing railroad track, in which said carriage means has wheels adapted to roll on the rails of said existing railroad track, and in which said first and second trackway means respectively are first and second railroad tracks each adapted to have said wheels roll thereon, said first railroad track being laterally spaced from said second railroad track, the lateral spacing being sufficient to permit movement of said load-transporting cars on said first and second railroad tracks.

12. The mobile trackway of claim 11, in which said lateral spacing is sufficient that the center of gravity of the load-transporting cars on said first railroad track is spaced outwardly from the adjacent rail of said existing railroad track, and the center of gravity of the load-transporting cars on said second railroad track is spaced outwardly from the remaining rail of said existing railroad track, and in which said stabilizing means recited in clause 1(*d*) comprises weight means incorporated in said carriage means and sufficiently heavy to prevent lateral tipping of said carriage means even when fully-loaded ones of said load-transporting cars are present on said first railroad track while no cars are present on said second railroad track.

13. The mobile trackway of claim 12, in which said first and second railroad tracks are disposed symmetrically about the longitudinal axis of said carriage means, and are spaced from each other a distance barely sufficient to permit simultaneous presence of said load-transporting cars on said first and second tracks.

14. The mobile trackway of claim 12, in which said weight means is substantially stationary and is present outboard of both sides of said existing railroad track.

15. The mobile trackway of claim 1, in which said first and second trackway means are disposed laterally of each other and are spaced sufficiently far apart that the center of gravity of the load-transporting cars on said first trackway means is spaced outwardly from the adjacent side of said existing trackway, and the center of gravity of the load-transporting cars on said second trackway means is spaced outwardly from the other side of said existing trackway, and in which said stabilizing means recited in clause 1(d) comprises weight means incorporated in said carriage means and sufficiently heavy to prevent lateral tipping of said carriage means even when fully-loaded ones of said load-transporting cars are present on said first trackway means while no cars are present on said second trackway means, and also to prevent lateral tipping of said carriage means even when fully-loaded ones of said load-transporting cars are present on said second trackway means while no cars are present on said first trackway means.

16. A mobile trackway, comprising:

a. a plurality of interconnected carriages adapted for moving along an existing trackway, b. at least one ramp car, adapted for moving along said existing trackway, connected to at least one end of said interconnected carriages, said ramp car having mounted thereupon a trackway registered with said existing trackway, said trackway on said ramp car being adapted for movement thereupon of load-transporting cars between said existing trackway and said carriages, c. trackway meanns adapted for the movement of said load-transporting cars thereupon, said trackway means being mounted on upper regions of said carriages, said trackway means including plural, substantially parallel trackways and at least one switching section, said switching section being connected between at least one of said parallel trackways and said trackway on said ramp car, whereby said load-transporting cars may be shunted from said trackway on said ramp car to at least one of said parallel trackways, and d. stabilizing means for maintaining said carriages in a laterally substantially level condition regardless of the positioning of said load-transporting cars on said trackway means and regardless of whether all of said load-transporting cars are fully loaded, said stabilizing means being self-contained within said carriages whereby no substantial lateral projections from said carriages are required and no carriage contact with other than said existing trackway is required.

17. The mobile trackway of claim 16 wherein said stabilizing means recited in clause 11(d) comprises ballast compartments in said carriages, said compartments being loaded with ballasting materials.

18. The mobile trackway of claim 16 further including means for connecting said carriages and said ramp car to a source of locomotion whereby said carriages and said ramp car may be moved along said existing trackway not only while said load-transporting cars are on said trackway means but also while said load-transporting cars are moving between said trackway means and said existing trackway.

19. The mobile trackway of claim 16 further including conveyor means for loading said load-transporting cars when said load-transporting cars are on said trackway means, regardless of the parallel trackway upon which said load-transporting cars are positioned.

20. The mobile trackway of claim 11 wherein only two of said trackways are provided in said trackway means.

21. The mobile trackway of claim 11, in which said stabilizing means recited in clause 11(d) comprises weight means incorporated in said carriages, in which said trackway means comprises two laterally-spaced parallel trackways at least parts of which are disposed outboard of said existing trackway, said parallel trackways being so located that the centers of gravity of load-transporting

22. A carriage for a mobile trackway, comprising:

a. a carriage bed having a substantially flat upper region adapted for mounting thereupon plural trackways for load-transporting cars, said bed being of substantial thickness and having longitudinal sides thereof angled inwardly to a narrower lower region, said sides and lower region being closed to form a hollow shell, and shell being adapted for receiving ballasting materials such as rock, concrete and scrap metal, and b. a plurality of wheels attached to said carriage bed, said wheels being adapted to roll along an existing trackway.

23. The carriage of claim 16 wherein said wheels are recessed into said lower region of said carriage whereby a low center of carriage gravity is achieved.

24. The carriage of claim 16 wherein said shell is sufficiently large that, when filled with ballast, said carriage remains substantially laterally level even when only one of said plural trackways has load-transporting cars thereupon.

25. The carriage of claim 16 wherein said carriage bed has two parallel trackways mounted thereupon.

26. The carriage of claim 19 wherein means are provided for connecting said carriage to other carriages in an articulating manner whereby the ends of said plurality of trackways mounted on said upper regions are in substantial alignment.

27. The carriage of claim 16 wherein said carriage bed has mounted thereon a switching element for switching load-transporting cars from two or more of said parallel trackways to a single trackway.

28. The carriage of claim 16, in which said carriage bed has two laterally-spaced parallel trackways mounted thereupon in a horizontal plane and in symmetrical relationship about the longitudinal axis of said carriage bed, the lateral spacing between said parallel trackways being sufficiently small to minimize the requirement for said ballasting materials but sufficiently great to permit simultaneous presence of said load-transporting cars on both of said trackings, the lateral spacing also being such that the center of gravity of said load-transporting cars on said parallel trackways are outboard of said existing trackway, the amount and location of said ballasting materials being such that said carriages will not tip laterally even when loaded ones of said load-transporting cars are on one of said trackways while none is on the other, and even when loaded ones of said load-transporting cars are on said other of said trackways while none is on said one trackway.

* * * * *

UNITED STATES PATENT OFFICE

CERTIFICATE OF CORRECTION

PATENT NO. : 3, 939, 777

DATED : February 24, 1976

INVENTOR(S) : Raymond D. Moran

It is certified that error appears in the above-identified patent and that said Letters Patent are hereby corrected as shown below:

Column 1, line 15, after "cars" and before "be" insert --- can ---.

Column 4, line 62, change "not" to --- no ---; line 64, change "thte" to --- the ---.

Column 5, line 16, change "25a" to --- 26a ---; line 30, change "$18 < W_1$" to --- $18 > W_1$ ---.

Column 6, line 67, change "foreward-" to --- forward- ---.

Column 7, line 61 (line 2 of claim 1), change "and" to --- an ---.

Column 8, line 7 (line 16 of claim 1), change "sttable" to --- stable ---.

Column 9, line 48 (line 13 of claim 16), change "meanns" to --- means ---.

Column 10, line 4 (line 2 of claim 17), change "11" to --- 16 ---; line 20 (line 1 of claim 20), change "11" to --- 16 ---; line 23 (line 1 of claim 21), change "11" to --- 16 ---; line 24 (line 2 of claim 21), change "11" to --- 16 ---; line 30 (line 8 of claim 21), after "load-transporting" insert the following: --- cars thereon are outboard of said existing trackway, and in which said weight means is stationary and is sufficiently heavy that said carriages will not tip laterally despite either (a) the presence of loaded cars on one of said parallel trackways while none is present on the other of said parallel trackways, or (b) the presence of loaded cars on said other of said parallel trackways while none is present on said one of said parallel trackways. ---; line 39 (line 9 of claim 22), change "and" to --- said ---; line 45 (line 1 of claim 23), change "16" to --- 22 ---; line 48 (line 1 of claim 24), change "16" to --- 22 ---; line 53 (line 1 of claim 25), change "16" to --- 22 ---; line 55 (line 1 of claim 26), change "19" to --- 25 ---; line 60 (line 1 of claim 27), change "16" to --- 22 ---; line 64 (line 1 of claim 28), change "16" to --- 22 ---.

Column 11, line 4 (line 9 of claim 28), change "trackings," to --- trackways, ---.

Signed and Sealed this

Twenty-first Day of September 1976

[SEAL]

*Attest:*

RUTH C. MASON
*Attesting Officer*

C. MARSHALL DANN
*Commissioner of Patents and Trademarks*